US010634442B2

(12) United States Patent
Fox et al.

(10) Patent No.: US 10,634,442 B2
(45) Date of Patent: Apr. 28, 2020

(54) LIGHT GUN BREECH POSITION DETECTOR

(71) Applicant: Cubic Corporation, San Diego, CA (US)

(72) Inventors: Andrew John Fox, Chippenham (GB); Byron Bradley, Chippenham (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/249,608

(22) Filed: Jan. 16, 2019

(65) Prior Publication Data

US 2019/0219350 A1 Jul. 18, 2019

Related U.S. Application Data

(60) Provisional application No. 62/618,513, filed on Jan. 17, 2018.

(51) Int. Cl.

| | |
|---|---|
| ***F41A 17/06*** | (2006.01) |
| ***F41A 3/66*** | (2006.01) |
| ***F41A 3/64*** | (2006.01) |

(52) U.S. Cl.

CPC ..... *F41A 17/06* (2013.01); *F41A 3/64* (2013.01); *F41A 3/66* (2013.01)

(58) Field of Classification Search

CPC ..... F41A 17/14; F41A 17/32; F41A 17/42; F41A 19/59; F41A 33/06; F41B 11/57

USPC ..... 42/1.01, 1.05, 1.04, 84

See application file for complete search history.

(56) References Cited

U.S. PATENT DOCUMENTS

| | | | | |
|---|---|---|---|---|
| 2,152,947 A * | 4/1939 | Blomerius | F41A 19/01 | 200/33 R |
| 2,507,798 A * | 5/1950 | Maxwell | F41A 19/01 | 235/103 |
| 3,099,793 A * | 7/1963 | Pinkley | G01R 33/46 | 324/313 |
| 3,487,297 A * | 12/1969 | Guyton | G01N 27/74 | 324/204 |
| 3,576,572 A * | 4/1971 | Braslau | G11C 11/39 | 257/E47.001 |

(Continued)

OTHER PUBLICATIONS

International Search Report dated Mar. 22, 2019 in International Patent Application No. PCT/US2019/013928, all pages.

*Primary Examiner* — Derrick R Morgan

(74) *Attorney, Agent, or Firm* — Kilpatrick Townsend & Stockton

(57) ABSTRACT

Systems and methods for detecting a position of a breech of a weapon using a breech position detector. The breech position detector includes one or more electrical leads configured to make physical contact with the weapon, a DC detector configured to detect a DC signal at one of the one or more electrical leads, a RF detector configured to detect a RF signal at one of the one or more electrical leads, and a controller. The controller is configured to perform operations including receiving the DC signal from the DC detector, receiving the RF signal from the RF detector, and determining the position of the breech based on one or both of the DC signal and the RF signal. The operations may also include comparing a magnitude of the DC signal to a DC threshold and comparing a magnitude of the RF signal to a RF threshold.

17 Claims, 11 Drawing Sheets

(56) References Cited

U.S. PATENT DOCUMENTS 3,636,449 A * 1/1972 Partridge ..... G01B 7/02 324/157
3,686,683 A * 8/1972 Powers ..... H01J 49/18 250/426
4,001,961 A * 1/1977 Johnson ..... F41A 19/01 324/94
4,092,867 A * 6/1978 Matzuk ..... A61B 8/00 600/445
4,487,469 A * 12/1984 Bjørk ..... H01R 33/9753 403/349
4,541,191 A * 9/1985 Morris ..... F41A 17/06 42/1.01
4,737,705 A * 4/1988 Bitar ..... F15B 15/2869 324/633
4,893,077 A * 1/1990 Auchterlonie ..... G01B 7/14 318/656
5,033,217 A * 7/1991 Brennan ..... F41A 3/64 42/1.01
5,177,952 A * 1/1993 Stone ..... F01K 25/005 60/39.12
5,182,908 A * 2/1993 Devier ..... E02F 9/2221 60/420
5,201,658 A * 4/1993 Taylor ..... F41A 33/06 434/11
5,214,916 A * 6/1993 Lukich ..... B60W 10/103 60/431
5,303,495 A 4/1994 Harthcock
5,383,390 A * 1/1995 Lukich ..... E02F 9/2203 60/426
5,402,678 A * 4/1995 Fritz ..... F41A 19/01 42/1.01
5,421,264 A * 6/1995 Petrick ..... F42B 5/08 102/201
5,438,274 A * 8/1995 Bitar ..... F15B 15/2869 324/636
5,471,147 A * 11/1995 Allen ..... F15B 15/2869 324/635
5,566,486 A * 10/1996 Brinkley ..... F41A 19/01 42/1.02
5,727,538 A * 3/1998 Ellis ..... F41B 11/52 124/32
6,176,169 B1 1/2001 Rostocil
6,208,133 B1 * 3/2001 Ehling ..... G01B 7/003 324/202
6,257,118 B1 * 7/2001 Wilbur ..... E02F 9/2203 137/625.65
6,269,728 B1 * 8/2001 Kern ..... F41A 19/61 42/84
6,447,504 B1 * 9/2002 Ben-Haim ..... A61B 18/24 606/10
6,453,154 B1 * 9/2002 Haber ..... H01Q 1/084 455/129
7,113,091 B2 * 9/2006 Script ..... G08B 13/08 310/311
7,594,502 B1 * 9/2009 Anderson ..... F41B 11/54 124/71
8,464,451 B2 * 6/2013 McRae ..... F41A 17/06 42/1.01
8,587,321 B2 * 11/2013 Chen ..... H01J 37/32935 324/509
8,826,794 B1 9/2014 Marshall et al.
2004/0121292 A1 * 6/2004 Chung ..... F41A 33/00 434/11
2005/0141997 A1 * 6/2005 Rast ..... F04D 25/088 416/229 R
2005/0257676 A1 * 11/2005 Ealovega ..... F41A 19/43 89/28.1
2006/0005825 A1 * 1/2006 Monks ..... F41B 11/57 124/77
2006/0220574 A1 * 10/2006 Ogawa ..... H01J 37/32082 315/111.21
2006/0293593 A1 * 12/2006 Govari ..... A61B 90/39 600/424
2007/0007923 A1 * 1/2007 Johansen ..... E06B 9/68 318/483
2007/0088527 A1 * 4/2007 Pchelnikov ..... G01P 3/64 702/150
2007/0167743 A1 * 7/2007 Honda ..... A61B 1/041 600/424
2008/0024119 A1 * 1/2008 Gualtieri ..... G01B 7/003 324/207.15
2008/0179525 A1 * 7/2008 Ikushima ..... G01J 5/02 250/338.1
2008/0215125 A1 * 9/2008 Farah ..... A61N 1/36082 607/116
2009/0012432 A1 * 1/2009 Sharf ..... A61B 5/0031 600/588
2009/0251372 A1 * 10/2009 Degner ..... H01Q 1/084 343/702
2010/0031552 A1 * 2/2010 Houde-Walter ..... F41A 35/00 42/72
2010/0154766 A1 * 6/2010 Skilling ..... F41A 1/06 124/71
2010/0251586 A1 * 10/2010 Packer ..... F41A 19/01 42/1.01
2010/0256476 A1 * 10/2010 Wood ..... A61M 16/04 600/409
2010/0258101 A1 * 10/2010 Campo ..... F41B 11/57 124/51.1
2011/0162943 A1 * 7/2011 Ashcroft ..... H01P 1/127 200/11 R
2012/0297654 A1 * 11/2012 Williams ..... F41A 17/063 42/1.01
2013/0192050 A1 * 8/2013 LeMieux ..... B21J 15/28 29/524.1
2013/0316308 A1 * 11/2013 Monti ..... F41A 33/06 434/16
2014/0272806 A1 * 9/2014 Hunt ..... F41A 33/00 434/16
2014/0373823 A1 * 12/2014 Stevens ..... F41B 11/51 124/56
2015/0053192 A1 * 2/2015 Italia ..... F41B 11/53 124/51.1
2016/0084605 A1 * 3/2016 Monti ..... A63F 13/837 463/2
2016/0305732 A1 * 10/2016 Jandl ..... G09B 9/003
2016/0377364 A1 * 12/2016 Santos Reis ..... F41A 19/69 89/135
2017/0051993 A1 * 2/2017 Imbriano ..... F41A 19/01
2018/0142978 A1 * 5/2018 Lamparter ..... F41A 19/01
2018/0364007 A1 * 12/2018 Armstrong ..... F41A 33/00

* cited by examiner

LIGHT GUN BREECH POSITION DETECTOR

CROSS-REFERENCES TO RELATED APPLICATIONS

This application is a nonprovisional of and claims the benefit of priority to U.S. Provisional Patent Application No. 62/618,513, filed Jan. 17, 2018, entitled "LIGHT GUN BREACH POSITION DETECTOR," the content of which is herein incorporated in its entirety.

BACKGROUND OF THE INVENTION

One aspect of weapon safety has been the proper closing of the breech of the weapon. Because many weapons fire a projectile by expanding a high-pressure gas, failure to close the breech can result in significant weapon malfunction and harm to the operator of the weapon through exposure to the high-pressure gas, the projectile, and/or weapon debris caused by the weapon malfunction. Conventional techniques to ensure the breech is closed are typically limited to the visual inspection of the weapon, which is prone to user error. The need to determine breech position is also present in weapon training exercises where an instructor must ensure that a trainee is properly and safely operating a weapon by completely closing the breech prior to firing the weapon. Because there is currently no available means for electronic detection of the breech position of a weapon, new systems and methods for solving the problem are needed.

SUMMARY OF THE INVENTION

Embodiments described herein may include methods, systems, and other techniques for implementing a weapon breech position detector. Examples given below provide a summary of the present invention. As used below, any reference to a series of examples is to be understood as a reference to each of those examples disjunctively (e.g., "Examples 1-4" is to be understood as "Examples 1, 2, 3, or 4").

Example 1 is a breech position detector configured to detect a position of a breech of a weapon, the breech position detector comprising: one or more electrical leads configured to make physical contact with the weapon; a direct-current (DC) detector configured to detect a DC signal at one of the one or more electrical leads; a radio-frequency (RF) detector configured to detect a RF signal at one of the one or more electrical leads; a controller including at least one processor and coupled to the DC detector and the RF detector, wherein the controller is configured to perform operations including: receiving the DC signal from the DC detector; receiving the RF signal from the RF detector; determining the position of the breech based on one or both of the DC signal and the RF signal.

Example 2 is the breech position detector of example(s) 1, wherein the DC signal and the RF signal are detected at a same electrical lead of the one or more electrical leads.

Example 3 is the breech position detector of example(s) 1-2, wherein the DC signal is a DC voltage signal and the RF signal is a RF voltage signal.

Example 4 is the breech position detector of example(s) 1-3, further comprising: a DC source providing a DC input signal at one of the one or more electrical leads; and a RF source providing a RF input signal at one of the one or more electrical leads.

Example 5 is the breech position detector of example(s) 1-4, wherein the RF signal is a reflected RF signal having a magnitude based on a difference between an impedance of the breech position detector and an impedance of the weapon.

Example 6 is the breech position detector of example(s) 1-5, wherein the position of the breech is either open or closed.

Example 7 is the breech position detector of example(s) 1-6, wherein the operations further comprise: comparing a magnitude of the DC signal to a DC threshold; comparing a magnitude of the RF signal to a RF threshold; determining that the position of the breech is closed when it is determined that the magnitude of the DC signal is less than the DC threshold; and determining that the position of the breech is open when it is determined that the magnitude of the DC signal is greater than the DC threshold and the magnitude of the RF signal is less than the RF threshold.

Example 8 is a method of detecting a position of a breech of a weapon, the method comprising: detecting, by a direct-current (DC) detector, a DC signal at one of one or more electrical leads, wherein the one or more electrical leads are configured to make physical contact with the weapon; detecting, by a radio-frequency (RF) detector, a RF signal at one of the one or more electrical leads; receiving, by a controller including at least one processor and coupled to the DC detector and the RF detector, the DC signal from the DC detector; receiving, by the controller, the RF signal from the RF detector; determining, by the controller, the position of the breech based on one or both of the DC signal and the RF signal.

Example 9 is the method of example(s) 8, wherein the DC signal and the RF signal are detected at a same electrical lead of the one or more electrical leads.

Example 10 is the method of example(s) 8-9, wherein the DC signal is a DC voltage signal and the RF signal is a RF voltage signal.

Example 11 is the method of example(s) 8-10, further comprising: providing, by a DC source, a DC input signal at one of the one or more electrical leads; and providing, by a RF source, a RF input signal at one of the one or more electrical leads.

Example 12 is the method of example(s) 8-11, wherein the RF signal is a reflected RF signal having a magnitude based on a difference between an impedance of a breech position detector and an impedance of the weapon.

Example 13 is the method of example(s) 8-12, wherein the position of the breech is either open or closed.

Example 14 is the method of example(s) 8-13, further comprising: comparing, by the controller, a magnitude of the DC signal to a DC threshold; comparing, by the controller, a magnitude of the RF signal to a RF threshold; determining, by the controller, that the position of the breech is closed when it is determined that the magnitude of the DC signal is less than the DC threshold; and determining, by the controller, that the position of the breech is open when it is determined that the magnitude of the DC signal is greater than the DC threshold and the magnitude of the RF signal is less than the RF threshold.

Example 15 is a weapon system comprising: a weapon comprising a breech; a breech position detector mountable to the weapon and configured to detect a position of the breech, the breech position detector comprising: one or more electrical leads configured to make physical contact with the weapon; a direct-current (DC) detector configured to detect a DC signal at one of the one or more electrical leads; a radio-frequency (RF) detector configured to detect a RF signal at one of the one or more electrical leads; a controller including at least one processor and coupled to the DC detector and the RF detector, wherein the controller is configured to perform operations including: receiving the DC signal from the DC detector; receiving the RF signal from the RF detector; determining the position of the breech based on one or both of the DC signal and the RF signal.

Example 16 is the weapon system of example(s) 15, wherein the DC signal and the RF signal are detected at a same electrical lead of the one or more electrical leads.

Example 17 is the weapon system of example(s) 15-16, wherein the DC signal is a DC voltage signal and the RF signal is a RF voltage signal.

Example 18 is the weapon system of example(s) 15-17, wherein the breech position detector further comprises: a DC source providing a DC input signal at one of the one or more electrical leads; and a RF source providing a RF input signal at one of the one or more electrical leads.

Example 19 is the weapon system of example(s) 15-18, wherein the RF signal is a reflected RF signal having a magnitude based on a difference between an impedance of the breech position detector and an impedance of the weapon.

Example 20 is the weapon system of example(s) 15-19, wherein the position of the breech is either open or closed, and wherein the operations further comprise: comparing a magnitude of the DC signal to a DC threshold; comparing a magnitude of the RF signal to a RF threshold; determining that the position of the breech is closed when it is determined that the magnitude of the DC signal is less than the DC threshold; and determining that the position of the breech is open when it is determined that the magnitude of the DC signal is greater than the DC threshold and the magnitude of the RF signal is less than the RF threshold.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

Figure 1:
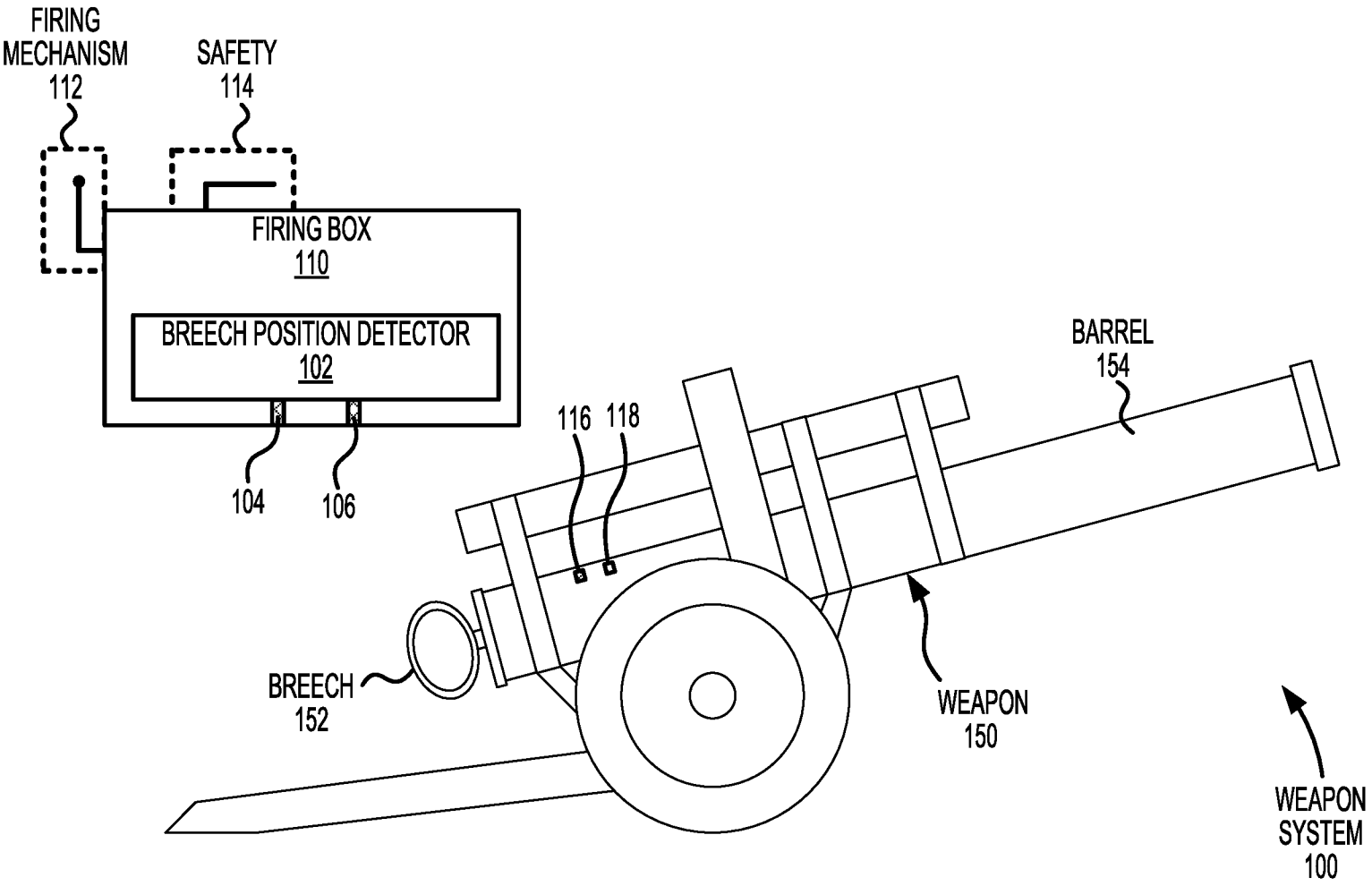
FIG. 1 illustrates a weapon system, according to some embodiments of the present invention.

In the appended figures, similar components and/or features may have the same numerical reference label. Further, various components of the same type may be distinguished by following the reference label with a letter or by following the reference label with a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION OF THE INVENTION

Embodiments of the invention described herein are generally related to the electronic determination of whether the breech of a weapon, such as an artillery weapon, is open or closed. Embodiments of the invention can be utilized during military training and other simulated exercises or, in some embodiments, during actual combat. That said, a person of ordinary skill in the art will understand that alternative embodiments may vary from the embodiments discussed herein, and applications may extend to various types of weapons beyond artillery weaponry, such as guns with similar firing mechanisms to that described herein.

During the course of weapons training, it can be important to know whether the breech of an artillery weapon is open or closed. This information can not only inform the user of the weapon, but a person or entity conducting a weapons training, to help determine and implement optimal practices, oversee training, etc. However, for many artillery weapons, there is currently no available electronic means of detecting the position of the breech. Embodiments provided herein are directed to providing such means.

Among other advantages, embodiments of the invention may provide electronic detection of the breech position on an artillery weapon, provide a level of redundancy via the combination of radio-frequency (RF) and direct-current (DC) components, and/or provide information that can be used for training purposes whereby an instructor can electronically observe the status of the breech. Embodiments may utilize the firing mechanism for detecting the breech position. For example, the mechanism may consist of a firing box (which attaches to the weapon and mates with the connectors) and an insulated cable that sends a voltage to the cartridge via the firing pin (thereby detonating the charge).

In some embodiments, a reliable, low voltage DC path between the firebox and the cartridge is achieved and DC continuity is used to detect the breech position. However, with metal corrosion, grease and dirt, a low voltage path could easily be interrupted leading to a false 'breech open' state. A high voltage would arc through any corrosion and across any gaps and allow the true state of the breech to be determined, however the use of high voltage presents safety concerns and therefore this approach is avoided. In some embodiments, a RF voltage is used to propagate through corroded junctions and across small metal gaps (that would otherwise block the conduction of low voltage DC). In this approach, a RF signal is injected onto the weapon and the reflected power is observed. At certain frequencies, and when the breech is open, the body of the gun will absorb the RF signal and very little energy will be reflected back to the RF source. When the breech is closed, the RF signal is shorted and a strong RF reflection is created.

In some embodiments, a process continuously sweeps the frequency of a synthesized frequency source over the range of frequencies that the weapon absorbs the RF energy (e.g., between 10 MHz to 40 MHz). A direction coupler may then pass the RF energy to the weapon via the firebox leads. If the breech is open, the RF energy will be absorbed by the weapon which has an equivalent circuit represented by a resonant circuit having a capacitor in parallel with an inductor and resistor. When the breech is closed, the RF energy is reflected back through the directional coupler and this reflected energy is measured by the power detector. A threshold can be set for how much reflected RF power constitutes breech open or breech closed. The actual threshold can be calibrated for each individual weapon.

In some embodiments, a DC continuity check can be included and a Boolean can be applied in which the breech is determined to be open when the detected reflected RF signal is less than a RF threshold and the detected DC signal is greater than a DC threshold. Otherwise, the breech is determined to be closed. In some embodiments, one or more switches can be utilized to enable a quick check with a very small pulse of microseconds or less. This has the effect of minimizing any potential electromagnetic compatibility (EMC) concerns that may exist.

FIG. 1 illustrates a weapon system 100, according to some embodiments of the present invention. Weapon system 100 may include a breech position detector 102 that is attachable, mountable, and/or integrated with a weapon 150. For example, breech position detector 102 may be a stand-alone device that is directly attachable to weapon 150 or may be a subcomponent of a larger device such as a firing box 110, which may be attachable, mountable, and/or integrated with weapon 150. In some embodiments, firing box 110 (and therefore breech position detector 102) may be integrated with weapon 100 upon manufacture of weapon system 100. In some embodiments, different firing boxes 110 may be attached to weapon 150 based on whether weapon system 100 is to be used for military training or for actual combat. When used for training, firing box 110 may be configured such that activation of firing mechanism 112 is unable to discharge weapon 150 and/or such that a safety 114 is always activated.

Weapon 150 may be any type of weapon having a movable breech 152 capable of being manually and/or automatically manipulated into at least two positions (e.g., open or closed). In some embodiments, weapon 150 includes a barrel 154 for directing a fired projectile towards a target. Breech 152 may be positioned at one end of barrel 154 and may include a movable door for opening or closing breech 152. In some embodiments, the movable component of breech 152 may be rotatable, pivotable, slidable, and/or removable such that, while the movable component is in a first position (e.g., breech 152 is "open"), a projectile to be fired by weapon 150 is at least partially or completely exposed and, while the movable component is in a second position (e.g., breech 152 is "closed"), the projectile is at least partially or completely enclosed. In some embodiments, weapon 150 is an indirect firing weapon capable of firing a projectile without relying on a direct line of sight between weapon 150 and a target. In some embodiments, weapon 150 is a direct firing weapon relying on a direct line of sight between weapon 150 and a target. In various embodiments, weapon 150 is one or more of a firearm, an air gun, a portable weapon, a stationary weapon, a handheld weapon, and the like.

Breech position detector 102 may include one or more electrical leads configured to make physical contact with one or more connectors of weapon 150 when breech position detector 102 is attached, mounted, and/or integrated with weapon 150. The electrical leads and connectors may be comprised of any one of various electrically conductive materials. In some embodiments, breech position detector 102 includes a signal lead 104 that may make physical contact with a detonate connector 116 of weapon 150 when breech position detector 102 is attached, mounted, and/or integrated with weapon 150. Signal lead 104 may carry a DC signal and/or a RF signal provided by breech position detector 102 and feed the signal(s) into detonate connector 116. In some embodiments, breech position detector 102 includes a ground lead 106 that may make physical contact with a ground connector 118 of weapon 150 when breech position detector 102 is attached, mounted, and/or integrated with weapon 150. The connection between ground lead 106 and ground connector 118 may ensure that breech position detector 102 and weapon 150 share a common ground and may, in some embodiments, enable breech position detector 102 to achieve connectivity and operate with an earth ground.

Figure 2:
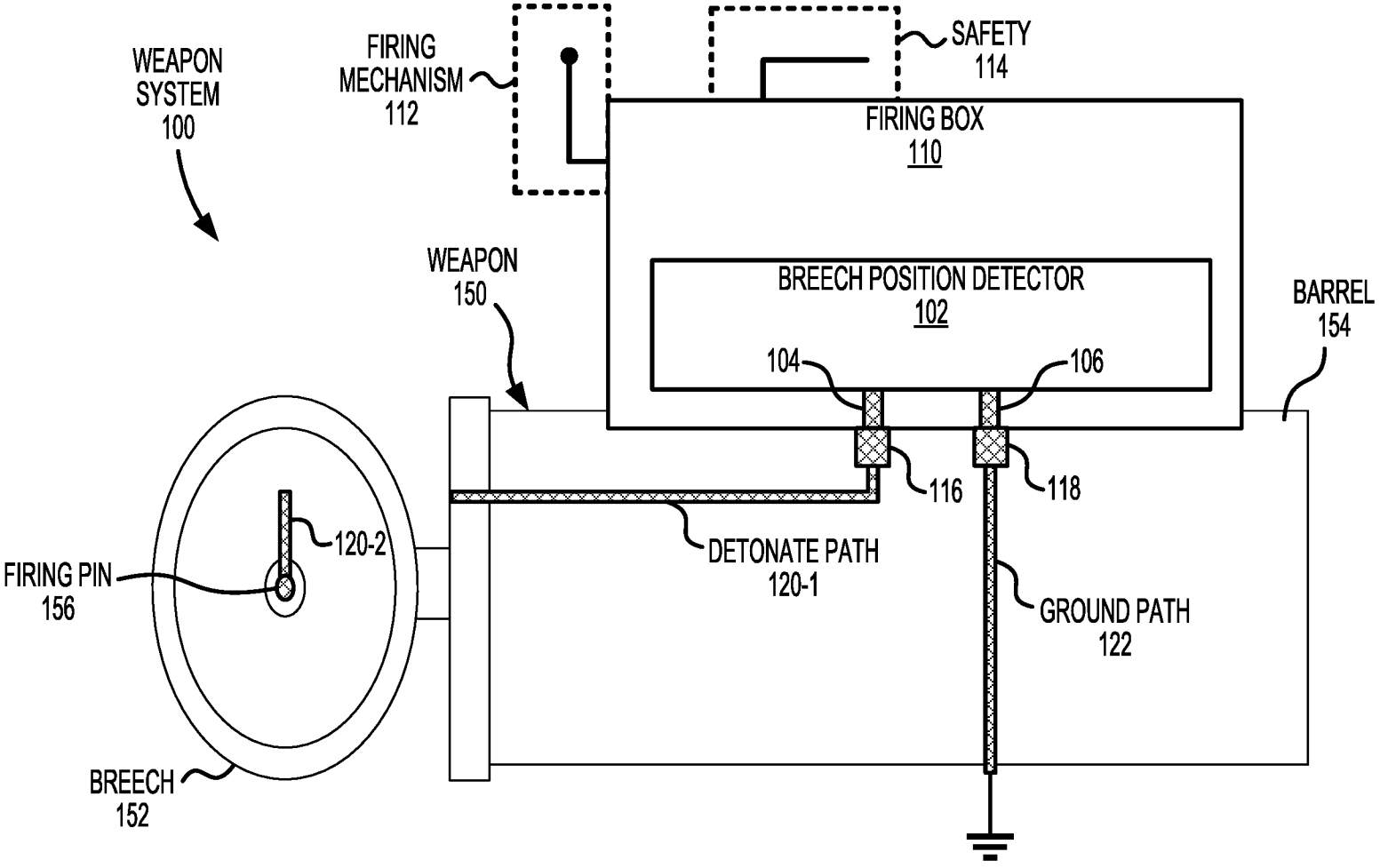
FIG. 2 illustrates a weapon system in which a firing box is attached to a weapon and a breech is open, according to some embodiments of the present invention.

FIG. 2 illustrates weapon system 100 in which firing box 110 is attached to weapon 150 and breech 152 is open, according to some embodiments of the present invention. A RF and/or DC signal provided by breech position detector 102 at signal lead 104 may be fed into detonate connector 116 and may propagate down a first portion of a detonate path 120-1 of weapon 150. In some instances, detonate path 120 comprises an insulated conductive path positioned along weapon 150. A first portion of detonate path 120-1 may be positioned within barrel 154 and a second portion of detonate path 120-2 may be positioned within breech 152 (e.g., the movable component of breech 152). The second portion of detonate path 120-2 may connect to a firing pin 156 which may connect the cartridge of the projectile when breech 152 is closed. Both firing pin 156 and the cartridge may be comprised of a conductive material such that a RF and/or DC signal propagating down the second portion of detonate path 120-2 may be fed into firing pin 156 and subsequently into the cartridge.

In the illustrated embodiment, breech 152 is open and the first portion of detonate path 120-1 is disconnected from the second portion of detonate path 120-2. In some embodiments, the distance between the first and second portions of detonate path 120-1, 120-2 is such that a RF signal propagating down the first portion of detonate path 120-1 is unable to carry into the second portion of detonate path 120-2 with signal power above a particular threshold.

In some embodiments, an electrical signal provided by breech position detector 102 at ground lead 106 may be fed into ground connector 118 and may propagate down a ground path 122. In some embodiments, ground path 122 comprises an insulated conductive path positioned along barrel 154. In some embodiments, ground path 122 connects to the ground below weapon system 100 thereby providing an earth ground to breech position detector 102.

Figure 3:
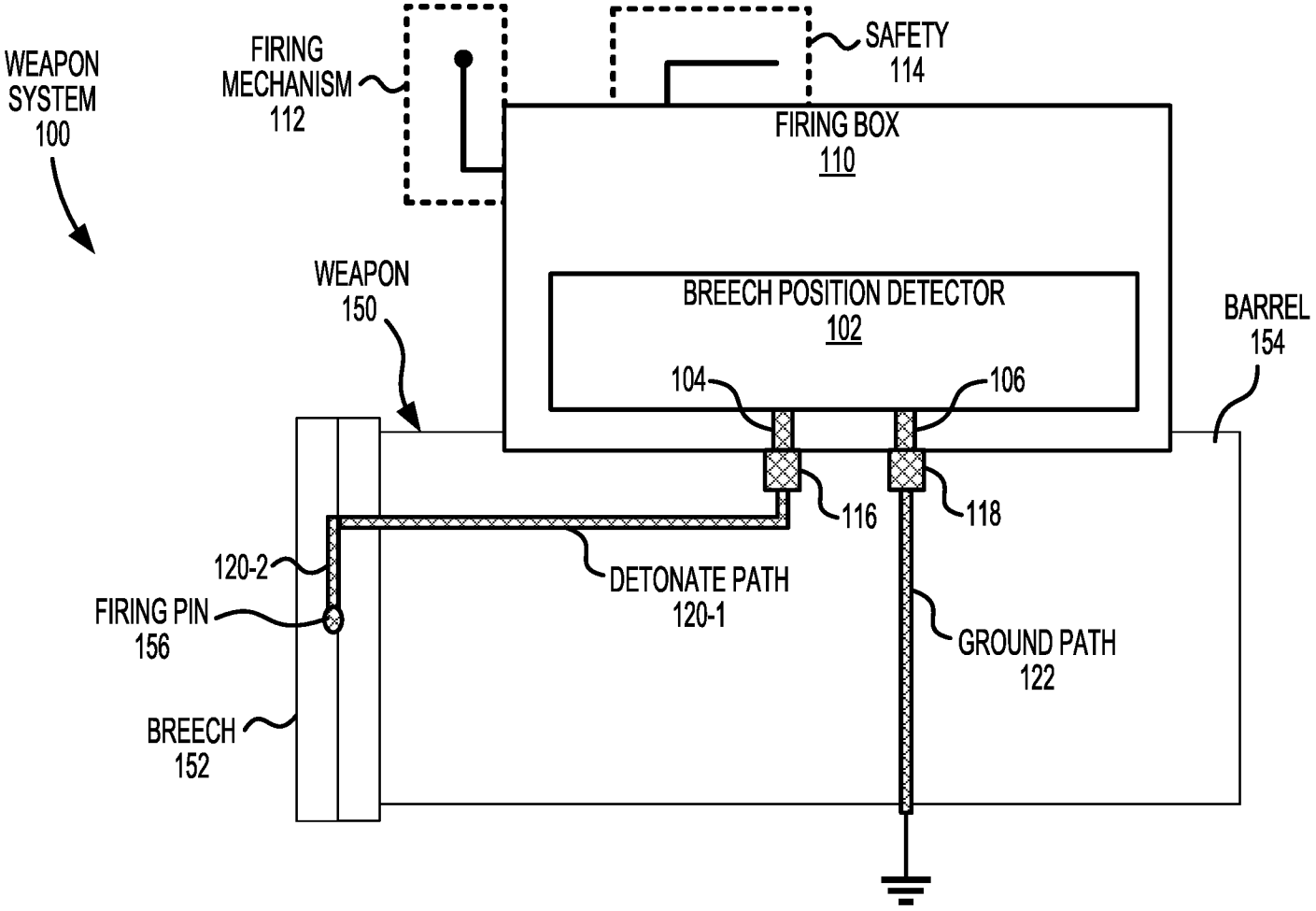
FIG. 3 illustrates a weapon system in which a firing box is attached to a weapon and a breech is closed, according to some embodiments of the present invention.

FIG. 3 illustrates weapon system 100 in which firing box 110 is attached to weapon 150 and breech 152 is closed, according to some embodiments of the present invention. In the illustrated embodiment, the first portion of detonate path

120-1 is in physical contact (i.e., is connected) to the second portion of detonate path 120-2. In some embodiments, the first portion of detonate path 120-1 does not make complete physical contact with the second portion of detonate path 120-2 when breech 152 is closed. In such embodiments, the distance between the first and second portions of detonate path 120-1, 120-2 is such that a RF signal propagating down the first portion of detonate path 120-1 is able to carry into the second portion of detonate path 120-2 with signal power above a particular threshold.

Figure 4:
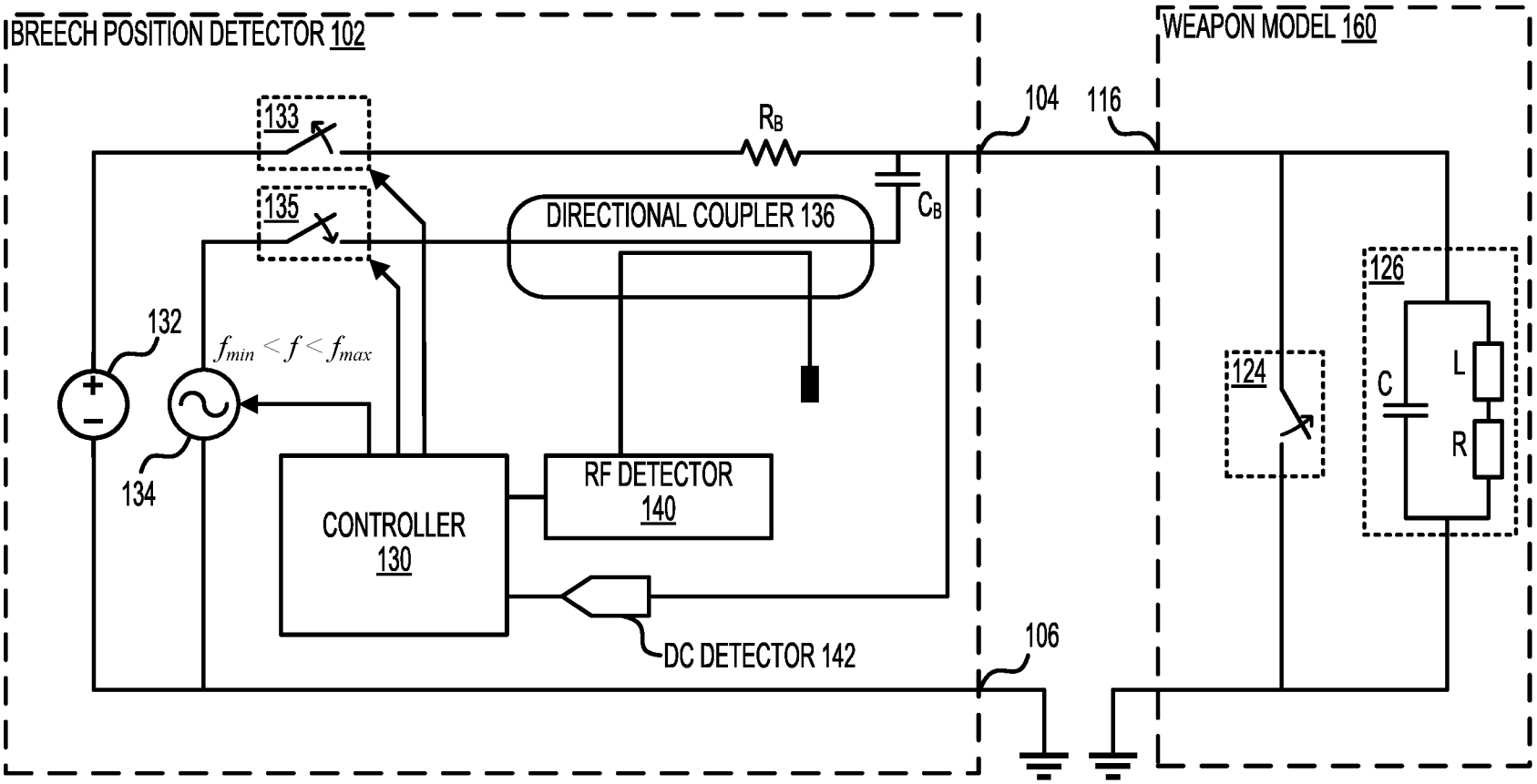
FIG. 4 illustrates a schematic diagram of a weapon system during a calibration step, according to some embodiments of the present invention.

FIG. 4 illustrates a schematic diagram of weapon system 100 during a calibration step, according to some embodiments of the present invention. Weapon 150 is represented in FIG. 4 by a weapon model 160, which includes a breach switch 124 and a resonant circuit 126. Breach 152 is represented in FIG. 4 by breach switch 124 such that breach switch 124 may be open or closed representing an open or closed breach 152, respectively. Resonant circuit 126 includes a capacitor C in parallel with an inductor L and a resistor R, which are in series with each other. Resonant circuit 126 has a resonant frequency $f_R$ based the values of capacitor C and inductor L. For example, in some embodiments, resonant frequency $f_R$ is equal to $1/\sqrt{LC}$ where C and L are the capacitance and inductance values of capacitor C and inductor L, respectively.

In some embodiments, breech position detector 102 includes a controller 130 for receiving, processing, and/or sending data. Controller 130 may include one or more processors and an associated memory. In some embodiments, breech position detector 102 includes a DC source 132 for providing (i.e., outputting) a DC input signal at signal lead 104. DC source 132 may be a voltage source such that the DC input signal is a voltage signal and/or DC source 132 may be a current source such that the DC input signal is a current signal. DC source 132 may be controlled directly by controller 130 and/or may be controlled via a switch 133 which either blocks or allows the DC signal to pass and reach signal lead 104. A bias resistor $R_B$ may be positioned between DC source 132 and signal lead 104 such that a DC current flow and a corresponding voltage drop may occur across bias resistor $R_B$ when the impedance of weapon model 160 is low and such that no DC current flow and no voltage drop may occur across bias resistor $R_B$ when the impedance of weapon model 160 is high.

In some embodiments, breech position detector 102 includes a RF source 134 for providing (i.e., outputting) a RF input signal at signal lead 104. RF source 134 may be a voltage source such that the RF input signal is a voltage signal and/or RF source 134 may be a current source such that the RF input signal is a current signal. In some embodiments, the RF input signal may be a sinusoidal signal having a magnitude and frequency f that are set by RF source 134. In some embodiments, RF source 134 may be controlled directly by controller 130 and/or may be controlled via a switch 135 which either blocks or allows the RF signal to pass and reach signal lead 104. In some embodiments, a directional coupler 136 may be positioned between RF source 134 and signal lead 104. Directional coupler 136 may be configured to allow signals moving from RF source 134 toward signal lead 104 to remain unaffected or substantially unaffected while signals moving from signal lead 104 toward RF source 134 are diverted toward a RF detector 140. Directional coupler 136 may divert a percentage of the signal moving from signal lead 104 toward RF source 134, such as 10%, 20%, 30%, 40%, 50%, 60%, 70%, 80%, 90%, 100%, or any percentage therein. In some embodiments, a DC-blocking capacitor CB is positioned between DC source 132 and the RF circuitry (e.g., RF source 134 and/or RF detector 140) to prevent DC signals from disrupting the RF circuitry.

In some embodiments, breech position detector 102 includes RF detector 140 for detecting a RF signal at signal lead 104 (or a different electrical lead of breech position detector 102), and a DC detector 142 for detecting a DC signal at signal lead 104 (or a different electrical lead of breech position detector 102). In some embodiments, one or both of RF detector 140 and DC detector 142 comprise an analog-to-digital converter. In some embodiments, RF detector 140 includes circuitry for demodulating the RF signal by mixing the RF signal with a local oscillator and filtering the mixed signal.

In the illustrated embodiment, a calibration step may be performed in which switch 133 is opened (or DC source 132 is turned off), switch 135 is closed, breech switch 124 is opened, and RF source 134 is controlled so as to sweep frequency f across multiple frequencies between a minimum frequency $f_{min}$ and a maximum frequency $f_{max}$. The reflected RF signal at each interrogated frequency may be detected by RF detector 140. In some embodiments, a magnitude (or power) of the detected RF signal may be extracted by RF detector 140 and/or controller 130. The range of frequencies may be discrete or continuous and, in some embodiments, multiple frequencies may be interrogated simultaneously to increase the speed of the calibration step. In such embodiments, the detected RF signal may be divided into different frequency components (using, for example, one or more band-pass filters) and the magnitude (or power) of each frequency component may be extracted by RF detector 140 and/or controller 130.

During the calibration step, the magnitude (or power) of the detected RF signal is analyzed as a function of frequency. In some embodiments, the frequency at which the maximum magnitude (or power) of detected RF signal occurs is determined to be resonant frequency $f_R$ of resonant circuit 126 (i.e., of weapon 150). In some embodiments, the frequency at which the minimum magnitude (or power) of detected RF signal occurs is determined to be resonant frequency $f_R$ of resonant circuit 126 (i.e., of weapon 150). As will be shown in reference to FIG. 7, in some embodiments, resonant frequency $f_R$ may not necessarily correspond to the frequency at which a maximum or minimum magnitude (or power) of detected RF signal occurs. Instead, a matched frequency $f_M$ at which the input impedance of breech position detector 102 matches the impedance of resonant circuit 126 is selected.

Figure 5:
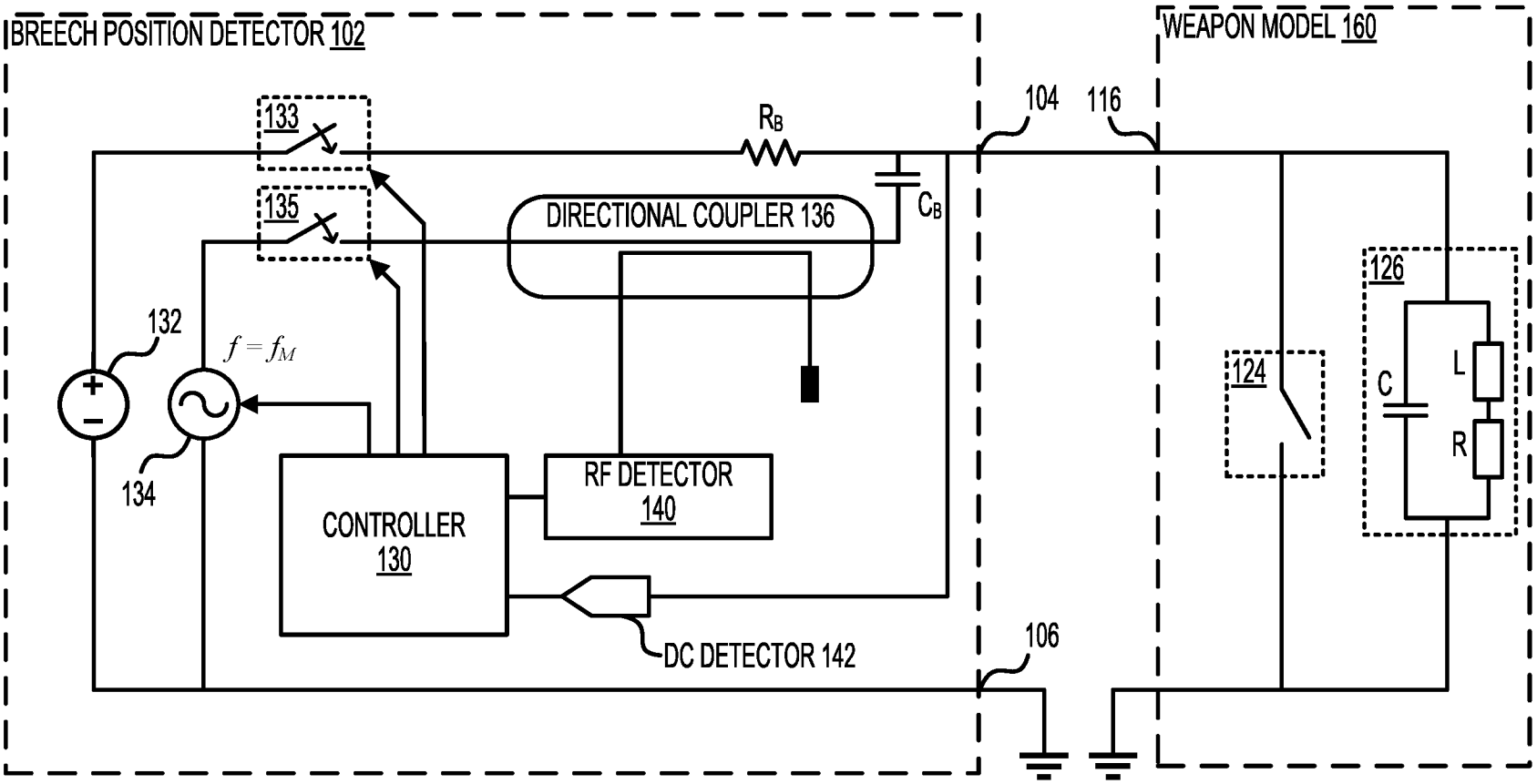
FIG. 5 illustrates a schematic diagram of a weapon system during a runtime step, according to some embodiments of the present invention.

FIG. 5 illustrates a schematic diagram of weapon system 100 during a runtime step, according to some embodiments of the present invention. In the illustrated embodiment, a runtime step may be performed in which switch 133 is closed, switch 135 is closed, DC source 132 provides a DC input signal at signal lead 104, and RF source 134 provides a RF input signal at signal lead 104. RF source 134 may be controlled such that the frequency of RF input signal is matched frequency $f_M$. Further during the runtime step, DC detector 142 may detect a DC signal at signal lead 104 and RF detector 140 may detect a RF signal at signal lead 104. Further during the runtime step, controller 130 may determine the position of breech 152 based on one or both of the detected DC signal and the detected RF signal.

Figure 6:
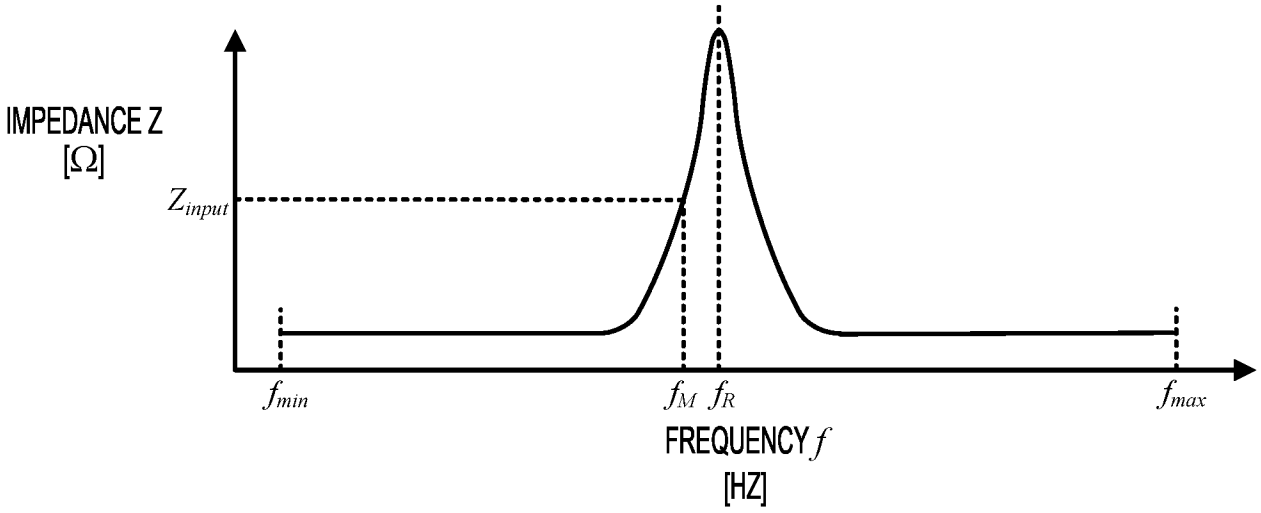
FIG. 6 illustrates the frequency-dependent impedance of a weapon model when a breach is open, according to some embodiments of the present invention.

FIG. 6 illustrates the frequency-dependent impedance Z of weapon model 160 when breach 152 is open, according to some embodiments of the present invention. The impedance has a maximum amplitude at resonant frequency $f_R$ with sharply decreasing values below and above. The steepness of the peak may be a function of resistor R, where lower values of R correspond to increased steepness of the peak. During the calibration step, matched frequency $f_M$ is selected, which is determined to be the frequency at which the input impedance $Z_{input}$ of breech position detector 102 matches the impedance of resonant circuit 126. In embodiments in which the maximum impedance of weapon model 160 is greater than the input impedance of breech position detector 102, matched frequency $f_M$ may be determined to be above or below resonant frequency $f_R$. In the illustrated embodiment, matched frequency $f_M$ is determined to be below resonant frequency $f_R$.

Figure 7:
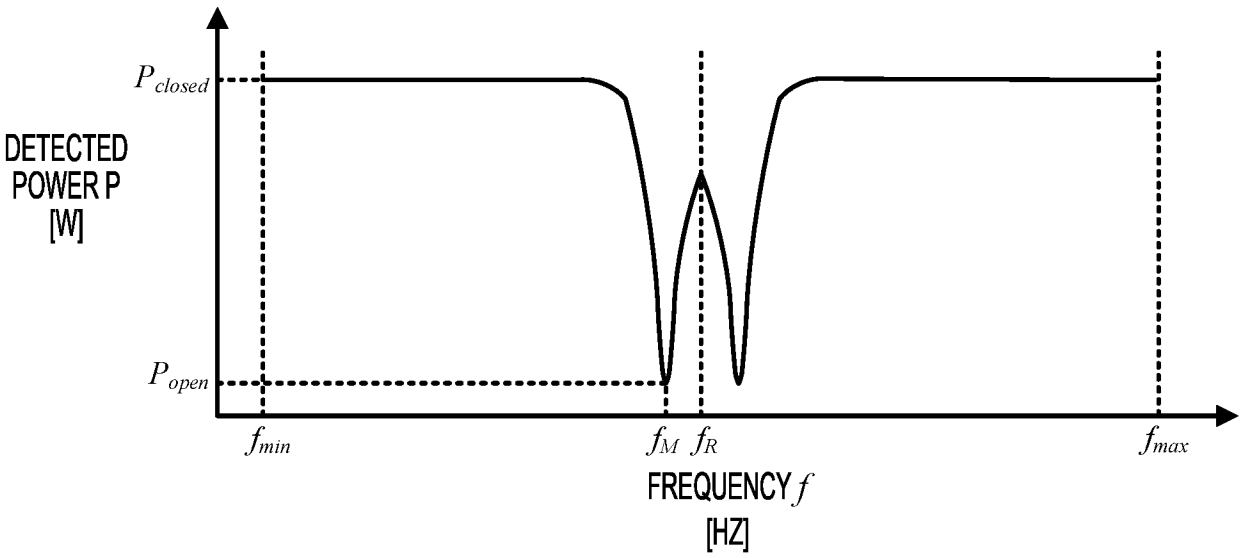
FIG. 7 illustrates the frequency-dependent detected power of a reflected RF signal, according to some embodiments of the present invention.

FIG. 7 illustrates the frequency-dependent detected power P of the reflected RF signal, according to some embodiments of the present invention. The plot shown in FIG. 7 corresponds to the plot shown in FIG. 6 in which the maximum impedance of weapon model 160 is greater than the input impedance of breech position detector 102, and matched frequency $f_M$ is determined to be below resonant frequency $f_R$. In some embodiments, matched frequency $f_M$ corresponds to the frequency at which a minimum or relative minimum power of the reflected RF signal is detected. During the calibration step, the detected power of the reflected RF signal at matched frequency $f_M$ may be defined as $P_{open}$ (i.e., the detected power when breech 152 is open during the runtime step) and the maximum detected power of the reflected RF signal (at frequencies distant from matched frequency $f_M$) may be defined as $P_{open}$ (i.e., the detected power when breech 152 is closed during the runtime step).

Figure 8A:
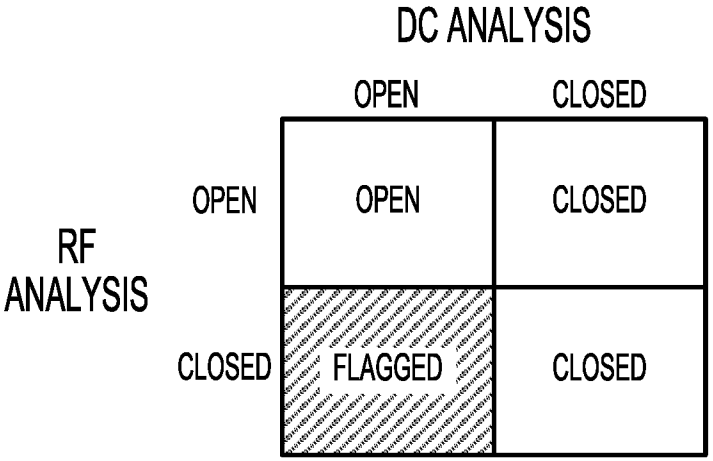
FIGS. 8A and 8B illustrate a decision matrix utilized by a controller in determining whether a breech is open or closed, according to some embodiments of the present invention.
Figure 8B:
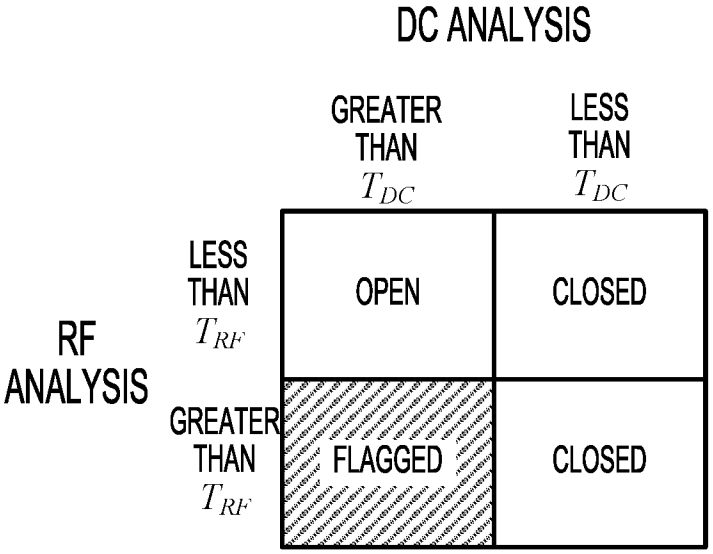

FIGS. 8A and 8B illustrate a decision matrix utilized by controller 130 in determining whether breech 152 is open or closed, according to some embodiments of the present invention. Referring to FIG. 8A, two separate inquiries are made into the position of breech 152 based either solely on DC analysis or RF analysis. In some embodiments, a first inquiry is made as to the position of breech 152 based solely on an analysis of the DC signal detected by DC detector 142. In some embodiments, a second inquiry is made as to the position of breech 152 based solely on an analysis of the RF signal detected by RF detector 140. The results of the two inquiries may then be compared to determine the position of breech 152. If the results of both inquiries are that breech 152 is open (top left quadrant), then it is determined that breech 152 is open. If the result of the first inquiry is that breech 152 is closed and the result of the second inquiry is that breech 152 is open (top right quadrant), then the DC analysis is considered to be controlling and it is determined that breech 152 is closed. If the results of both inquiries are that breech 152 is closed (bottom right quadrant), then it is determined that breech 152 is closed. If the result of the first inquiry is that breech 152 is open and the result of the second inquiry is that breech 152 is closed (bottom left quadrant), then the result is flagged and it is neither determined that breech 152 is open nor closed. In some embodiments, the operator of weapon system 100 may be alerted of an error and/or may be instructed to reopen and/or reclose breech 152.

FIG. 8B shows one possible implementation for the decision matrix described in reference to FIG. 8A. For the first inquiry, a magnitude of the DC signal detected by DC detector 142 is compared to a DC threshold $T_{DC}$. For the second inquiry, a magnitude of the RF signal detected by RF detector 140 is compared to a RF threshold $T_{RF}$. If the magnitude of the DC signal is greater than DC threshold $T_{DC}$ and the magnitude of the RF signal is less than RF threshold $T_{RF}$ (top left quadrant), then it is determined that breech 152 is open. If the magnitude of the DC signal is less than DC threshold $T_{DC}$ and the magnitude of the RF signal is less tha RF threshold $T_{RF}$ (top right quadrant), then it is determined that breech 152 is closed. If the magnitude of the DC signal is less than DC threshold $T_{DC}$ and the magnitude of the RF signal is greater tha RF threshold $T_{RF}$ (bottom right quadrant), then it is determined that breech 152 is closed. If the magnitude of the DC signal is greater than DC threshold $T_{DC}$ and the magnitude of the RF signal is greater tha RF threshold $T_{RF}$ (bottom left quadrant), then the result is flagged and the operator of weapon system 100 may be alerted of an error and/or may be instructed to reopen and/or reclose breech 152.

Figure 9:
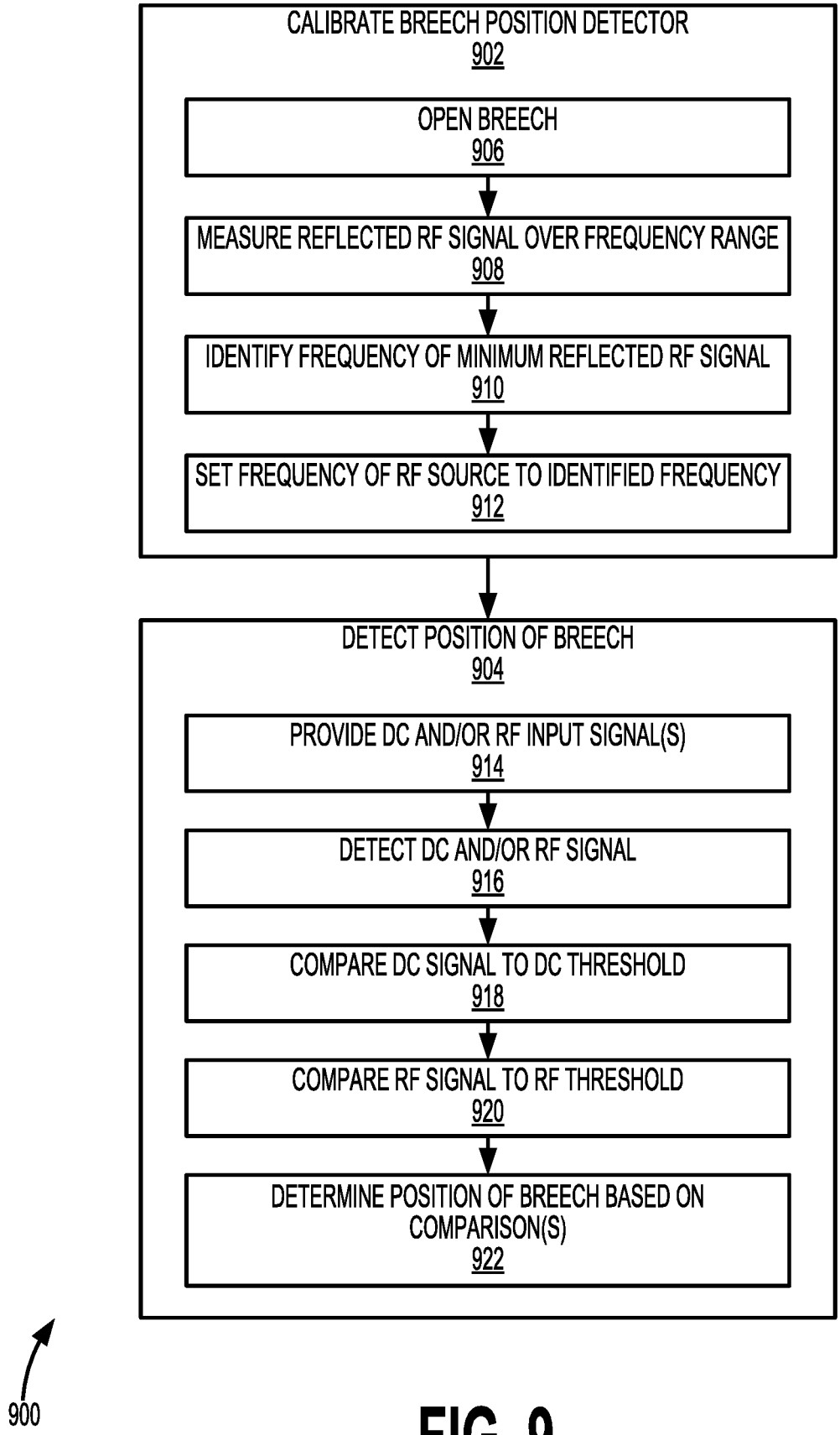
FIG. 9 illustrates a method, according to some embodiments of the present invention.

FIG. 9 illustrates a method 900, according to some embodiments of the present invention. One or more steps may be omitted during performance of method 900, and one or more steps may be performed in an order different than that shown. At step 902, breech position detector 102 is calibrated. Step 902 may correspond to the "calibration step" as described herein. At step 904, the position of breech 152 is detected using breech position detector 102 as calibrated during step 902. Step 904 may correspond to the "runtime step" as described herein.

At step 906, breech 152 is opened. Breech 152 may be manually (e.g., by the operator of weapon system 100) or automatically opened (e.g., by an actuator mechanically coupled to breech 152). In some embodiments, step 906 is performed by and/or is facilitated by controller 130.

At step 908, an input RF signal is provided by RF source 134 over a range of frequencies and the reflected RF signal is measured by RF detector 140 over the range of frequencies. The reflected RF signal may be measured at two or more frequencies sequentially or concurrently. In some embodiments, step 908 is performed by and/or is facilitated by controller 130.

At step 910, the frequency at which the reflected RF signal has a minimum value is identified. In embodiments in which more than one frequency is identified at which the reflected RF signal has a minimum value, one of the frequencies may be selected randomly or the lowest or highest frequency may be selected. In some embodiments, matched frequency $f_M$ is set to the identified frequency. In some embodiments, step 910 is performed by and/or is facilitated by controller 130.

At step 912, the frequency of the RF input signal that is provided by RF source 134 is set to the identified frequency. In some embodiments, the frequency of the RF input signal is set to matched frequency $f_M$. In some embodiments, step 910 is performed by and/or is facilitated by controller 130.

At step 914, DC source 132 provides (i.e., outputs) a DC input signal and/or RF source 140 provides (i.e., outputs) a RF input signal. In some embodiments, the DC input signal and the RF input signal are provided at signal lead 104. In some embodiments, the DC input signal is provided at a different lead of breech position detector 102 than the RF input signal. In some embodiments, the DC input signal is provided simultaneously or concurrently with the RF input signal. In some embodiments, the DC input signal is provided at a different time interval than the time interval during which the RF input signal is provided. In some embodiments, the DC input signal is a DC voltage. In some embodiments, the RF input signal is a sinusoidal voltage having a frequency equal to matched frequency $f_M$. In some embodiments, step 914 is performed by and/or is facilitated by controller 130.

At step 916, DC detector 142 detects a DC signal and/or RF detector 140 detects a RF signal. In some embodiments, the DC signal is fed to and is received by controller 130 and/or the RF signal is fed to and is received by controller 130. In some embodiments, a magnitude or amplitude of the DC signal is detected by DC detector 142 and is fed to controller 130. In other embodiments, or in the same embodiments, the magnitude or amplitude of the DC signal is determined by controller 130. In some embodiments, a magnitude or amplitude of the RF signal is detected by RF detector 140 and is fed to controller 130. In other embodiments, or in the same embodiments, the magnitude or amplitude of the RF signal is determined by controller 130. In some embodiments, step 916 is performed by and/or is facilitated by controller 130.

At step 918, the magnitude of the DC signal is compared to DC threshold $T_{DC}$. In some embodiments, step 918 is performed by and/or is facilitated by controller 130.

At step 920, the magnitude of the RF signal is compared to RF threshold $T_{RF}$. In some embodiments, step 920 is performed by and/or is facilitated by controller 130.

At step 922, the position of breech 152 is determined based on analysis of one or both of the DC signal and the RF signal. In some embodiments, the position of breech 152 is determined based on one or both of the comparisons made in steps 918 and 920. In some embodiments, it is determined that breech 152 is closed when the magnitude of the DC signal is less than DC threshold $T_{DC}$ and that breech 152 is open when the magnitude of the DC signal is greater than DC threshold $T_{DC}$ and the magnitude of the RF signal is less than RF threshold $T_{RF}$.

In one example of method 900, step 904 (which includes steps 914-922) is performed in response to the operator of weapon system 100 activating firing mechanism 112. In such embodiments, in response to determining that firing mechanism 112 was activated, steps 914 and 916 may be immediately performed during which DC input signal and RF input signal are provided as short 50 ms pulses and the detectors 140, 142 detect the resulting electrical signals during the same time frame. The remaining steps 918-922 may immediately be performed thereafter to determine the position of breech 152 and to prevent the firing of weapon 150 if it is determined that breech 152 is open. Such embodiments significantly improve the safety of weapon system 100 and solve the need of quickly preventing the firing of weapon 150 after firing mechanism 112 is activated. In order to perform this function under the imposed time constraints, controller 130 may generate the 50 ms (or much shorter) input signal pulses by opening and closing high speed switches 133, 135 immediately after determining that firing mechanism 112 was activated.

Figure 10:
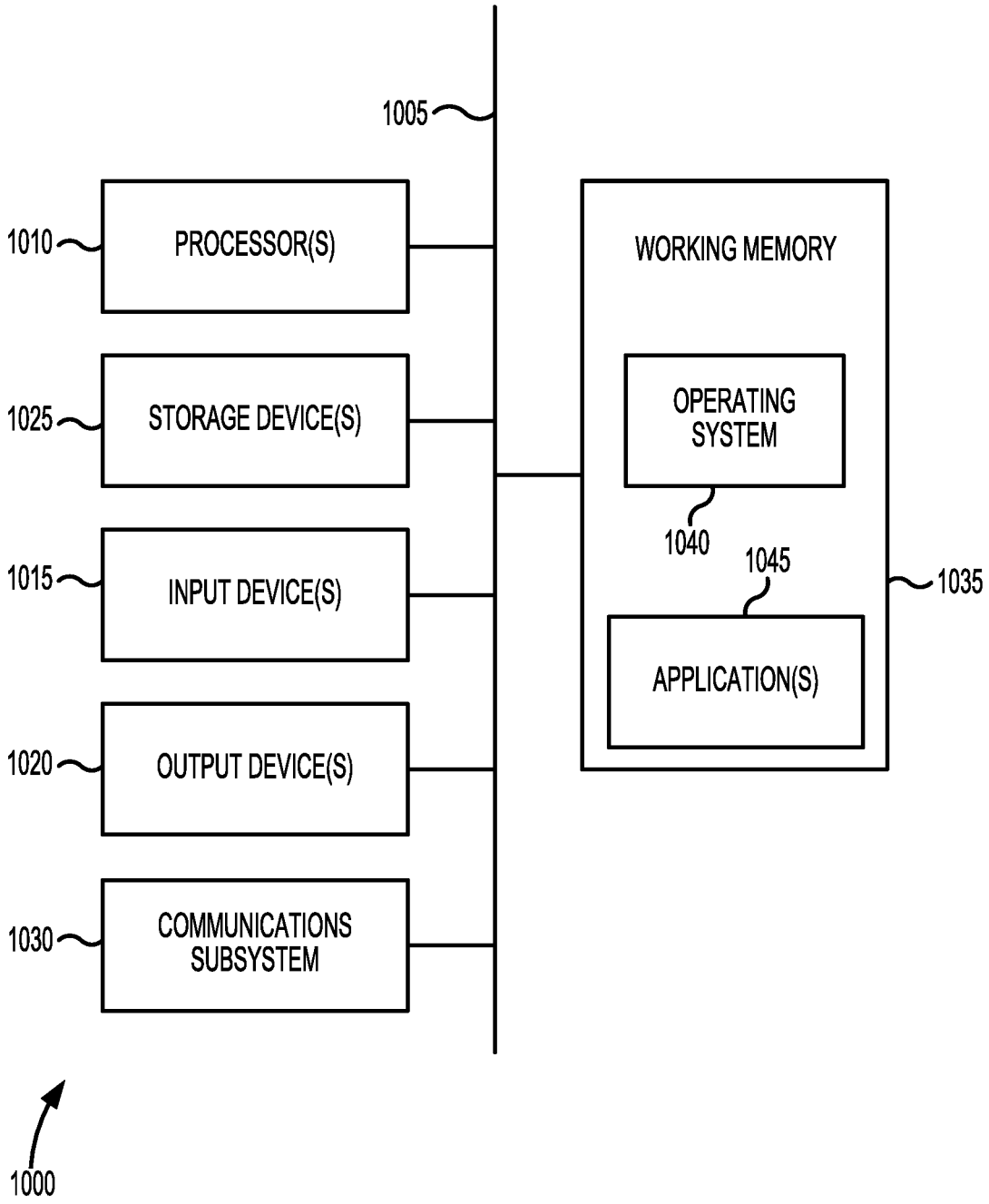
FIG. 10 shows an example of a simplified computer system, according to some embodiments of the present disclosure.

FIG. 10 shows an example of a simplified computer system 1000, according to some embodiments of the present disclosure. FIG. 10 provides a schematic illustration of one embodiment of a computer system 1000 that can perform some or all of the steps of the methods provided by various embodiments. It should be noted that FIG. 10 is meant only to provide a generalized illustration of various components, any or all of which may be utilized as appropriate. FIG. 10, therefore, broadly illustrates how individual system elements may be implemented in a relatively separated or relatively more integrated manner.

The computer system 1000 is shown comprising hardware elements that can be electrically coupled via a bus 1005, or may otherwise be in communication, as appropriate. The hardware elements may include one or more processors 1010, including without limitation one or more general-purpose processors and/or one or more special-purpose processors such as digital signal processing chips, graphics acceleration processors, and/or the like; one or more input devices 1015, which can include without limitation a mouse, a keyboard, a camera, and/or the like; and one or more output devices 1020, which can include without limitation a display device, a printer, and/or the like.

The computer system 1000 may further include and/or be in communication with one or more non-transitory storage devices 1025, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The computer system 1000 might also include a communications subsystem 1030, which can include without limitation a modem, a network card (wireless or wired), an infrared communication device, a wireless communication device, and/or a chipset such as a Bluetooth® device, an 802.11 device, a Wi-Fi device, a WiMAX™ device, cellular communication facilities, etc., and/or the like. The communications subsystem 1030 may include one or more input and/or output communication interfaces to permit data to be exchanged with a network such as the network described below to name one example, other computer systems, television, and/or any other devices described herein. Depending on the desired functionality and/or other implementation concerns, a portable electronic device or similar device may communicate image and/or other information via the communications subsystem 1030. In other embodiments, a portable electronic device, e.g. the first electronic device, may be incorporated into the computer system 1000, e.g., an electronic device as an input device 1015. In some embodiments, the computer system 1000 will further comprise a working memory 1035, which can include a RAM or ROM device, as described above.

The computer system 1000 also can include software elements, shown as being currently located within the working memory 1035, including an operating system 1040, device drivers, executable libraries, and/or other code, such as one or more application programs 1045, which may comprise computer programs provided by various embodiments, and/or may be designed to implement methods, and/or configure systems, provided by other embodiments, as described herein. Merely by way of example, one or more procedures described with respect to the methods discussed above, such as those described in relation to FIG. 10, might be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 1025 described above. In some cases, the storage medium might be incorporated within a computer system, such as computer system 1000. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by the computer system 1000 and/or might take the form of source and/or installable code, which, upon compilation and/or installation on the computer system 1000 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware, software including portable software, such as applets, etc., or both. Further, connection to other computing devices such as network input/output devices may be employed.

As mentioned above, in one aspect, some embodiments may employ a computer system such as the computer system 1000 to perform methods in accordance with various embodiments of the technology. According to a set of embodiments, some or all of the procedures of such methods are performed by the computer system 1000 in response to processor 1010 executing one or more sequences of one or more instructions, which might be incorporated into the operating system 1040 and/or other code, such as an application program 1045, contained in the working memory 1035. Such instructions may be read into the working memory 1035 from another computer-readable medium, such as one or more of the storage device(s) 1025. Merely by way of example, execution of the sequences of instructions contained in the working memory 1035 might cause the processor(s) 1010 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using the computer system 1000, various computer-readable media might be involved in providing instructions/code to processor(s) 1010 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 1025. Volatile media include, without limitation, dynamic memory, such as the working memory 1035.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 1010 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 1000.

The communications subsystem 1030 and/or components thereof generally will receive signals, and the bus 1005 then might carry the signals and/or the data, instructions, etc. carried by the signals to the working memory 1035, from which the processor(s) 1010 retrieves and executes the instructions. The instructions received by the working memory 1035 may optionally be stored on a non-transitory storage device 1025 either before or after execution by the processor(s) 1010.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a schematic flowchart or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A breech position detector configured to detect a position of a breech of a weapon, the breech position detector comprising:

an electrical lead configured to make physical contact with the weapon;

a direct-current (DC) detector configured to detect a DC signal at the electrical lead;

a radio-frequency (RF) detector configured to detect a RF signal at the electrical lead; and a controller including at least one processor and coupled to the DC detector and the RF detector, wherein the controller is configured to perform operations including:

receiving the DC signal from the DC detector;

receiving the RF signal from the RF detector; and determining the position of the breech based on one or both of the DC signal and the RF signal.

2. The breech position detector of claim 1, wherein the DC signal is a DC voltage signal and the RF signal is a RF voltage signal.

3. The breech position detector of claim 1, further comprising:

a DC source providing a DC input signal at the electrical lead; and a RF source providing a RF input signal at the electrical lead.

4. The breech position detector of claim 1, wherein the RF signal is a reflected RF signal having a magnitude based on a difference between an impedance of the breech position detector and an impedance of the weapon.

5. The breech position detector of claim 1, wherein the position of the breech is either open or closed.

6. The breech position detector of claim 5, wherein the operations further comprise:

comparing a magnitude of the DC signal to a DC threshold;

comparing a magnitude of the RF signal to a RF threshold;

determining that the position of the breech is closed when it is determined that the magnitude of the DC signal is less than the DC threshold; and determining that the position of the breech is open when it is determined that the magnitude of the DC signal is greater than the DC threshold and the magnitude of the RF signal is less than the RF threshold.

7. A method of detecting a position of a breech of a weapon, the method comprising:

detecting, by a direct-current (DC) detector, a DC signal at an electrical lead, wherein the electrical lead is configured to make physical contact with the weapon;

detecting, by a radio-frequency (RF) detector, a RF signal at the mere electrical lead;

receiving, by a controller including at least one processor and coupled to the DC detector and the RF detector, the DC signal from the DC detector;

receiving, by the controller, the RF signal from the RF detector; and determining, by the controller, the position of the breech based on one or both of the DC signal and the RF signal.

8. The method of claim 7, wherein the DC signal is a DC voltage signal and the RF signal is a RF voltage signal.

9. The method of claim 7, further comprising:

providing, by a DC source, a DC input signal at the electrical lead; and providing, by a RF source, a RF input signal at the electrical lead.

10. The method of claim 7, wherein the RF signal is a reflected RF signal having a magnitude based on a difference between an impedance of a breech position detector and an impedance of the weapon.

11. The method of claim 7, wherein the position of the breech is either open or closed.

12. The method of claim 11, further comprising:

comparing, by the controller, a magnitude of the DC signal to a DC threshold;

comparing, by the controller, a magnitude of the RF signal to a RF threshold;

determining, by the controller, that the position of the breech is closed when it is determined that the magnitude of the DC signal is less than the DC threshold; and determining, by the controller, that the position of the breech is open when it is determined that the magnitude of the DC signal is greater than the DC threshold and the magnitude of the RF signal is less than the RF threshold.

13. A weapon system comprising:

a weapon comprising a breech; and a breech position detector mountable to the weapon and configured to detect a position of the breech, the breech position detector comprising:

an electrical lead configured to make physical contact with the weapon;

a direct-current (DC) detector configured to detect a DC signal at the electrical lead;

a radio-frequency (RF) detector configured to detect a RF signal at the electrical lead; and a controller including at least one processor and coupled to the DC detector and the RF detector, wherein the controller is configured to perform operations including:

receiving the DC signal from the DC detector;

receiving the RF signal from the RF detector; and determining the position of the breech based on one or both of the DC signal and the RF signal.

14. The weapon system of claim 13, wherein the DC signal is a DC voltage signal and the RF signal is a RF voltage signal.

15. The weapon system of claim 13, wherein the breech position detector further comprises:

a DC source providing a DC input signal at the electrical lead; and a RF source providing a RF input signal at the electrical lead.

16. The weapon system of claim 13, wherein the RF signal is a reflected RF signal having a magnitude based on a difference between an impedance of the breech position detector and an impedance of the weapon.

17. The weapon system of claim 13, wherein the position of the breech is either open or closed, and wherein the operations further comprise:

comparing a magnitude of the DC signal to a DC threshold;

comparing a magnitude of the RF signal to a RF threshold;

determining that the position of the breech is closed when it is determined that the magnitude of the DC signal is less than the DC threshold; and determining that the position of the breech is open when it is determined that the magnitude of the DC signal is greater than the DC threshold and the magnitude of the RF signal is less than the RF threshold.

* * * * *